US007841921B2

(12) United States Patent
Wong et al.

(10) Patent No.: US 7,841,921 B2
(45) Date of Patent: Nov. 30, 2010

(54) SOFT TOY OR DOLL

(75) Inventors: Tak Ko Wong, Kwun Tong (HK); Cecil Shu On Chan, Hong Kong SAR (CN)

(73) Assignee: T.K. Wong & Associates Ltd., Hong Kong SAR (CN)

( * ) Notice: Subject to any disclaimer, the term of this patent is extended or adjusted under 35 U.S.C. 154(b) by 484 days.

(21) Appl. No.: 11/416,705

(22) Filed: May 3, 2006

(65) Prior Publication Data

US 2007/0259597 A1 Nov. 8, 2007

(30) Foreign Application Priority Data

Apr. 3, 2006 (GB) ..... 0606670.8

(51) Int. Cl.
*A63H 3/36* (2006.01)

(52) U.S. Cl. ..... 446/320; 446/385; 446/390

(58) Field of Classification Search ..... 446/320, 446/385, 390
See application file for complete search history.

(56) References Cited

U.S. PATENT DOCUMENTS

| | | | | | |
|---|---|---|---|---|---|
| 1,880,109 | A * | 9/1932 | Sanders | 446/376 |
| 2,134,974 | A * | 11/1938 | Hurwitz | 40/411 |
| 2,360,017 | A * | 10/1944 | Roman | 19/149 |
| 4,169,336 | A * | 10/1979 | Kuhn | 446/267 |
| 4,884,991 | A * | 12/1989 | Terzian | 446/369 |
| 5,066,259 | A * | 11/1991 | Acker | 446/385 |
| 5,462,473 | A * | 10/1995 | Sheller | 446/183 |
| 6,808,437 | B2 * | 10/2004 | Podd et al. | 446/320 |
| 7,507,138 | B2 * | 3/2009 | Chernick et al. | 446/268 |
| 2007/0072512 | A1 * | 3/2007 | Chernick et al. | 446/369 |
| 2007/0072515 | A1 * | 3/2007 | Chernick et al. | 446/385 |

FOREIGN PATENT DOCUMENTS

| | | | |
|---|---|---|---|
| DE | 147051 | | 3/1981 |
| DE | 147051 | A * | 3/1981 |
| GB | 1 419 588 | | 12/1975 |
| WO | WO 2006021789 | A1 * | 3/2006 |

* cited by examiner

*Primary Examiner*—Gene Kim
*Assistant Examiner*—Alyssa M Hylinski
(74) *Attorney, Agent, or Firm*—Jackson Walker, LLP

(57) ABSTRACT

A toy has a figure of a human or animal. The figure has a body made of a fabrics material and at least one appendage made of a soft flexible material. The appendage has a fabric piece fused to it during making and is joined to the body by stitched the fabric piece to the body.

9 Claims, 4 Drawing Sheets

SOFT TOY OR DOLL

FIELD OF THE INVENTION

The current invention relates to soft toys and dolls. Such soft toys and dolls are sometimes referred to as stuffed toys and/or plush dolls.

BACKGROUND TO THE INVENTION

Soft toys and dolls are popular play items among children. Such toys usually have a human, animal or creature shape and are made with a soft, sometimes fluffy or furry, textile outer covering filled with a soft resilient filler material such as cotton fiber. While such toys are fun to play with and can be squeezed and cuddled children can quickly become bored of them. Children, during play, often like to pull, distort and deform objects and known soft toys either do not respond to such stimuli or are easily damaged by it.

SUMMARY OF THE INVENTION

It is an object of the present invention to provide a soft toy and/or doll that has improved entertainment features for young children, or that at least provides the public with a useful, and fun, alternative.

There is disclosed herein a toy comprising a figure of a human or an animal having at least one appendage made of a soft flexible material, wherein the appendage is attached to the figure by a fabric piece that is fused to the appendage and is stitched to the figure.

Preferably, the appendage is made of an elastomeric gel plastic formed in a mold with the fabric piece.

Preferably, the appendage is made of an elastomeric gel plastic formed in a mold and is bonded to the fabric piece by adhesive.

Preferably, the fabric piece is a fabric sleeve that is fused about an outer end of the appendage.

Preferably, the appendage has a distal end having an indentation or hollowed end into which the fabric piece is fused.

Preferably, the appendage has a wall and is hollow at its center and the fabric piece has an end that is fused within the wall.

Preferably, the gelatinous compound consists of SEEPS or SEBS and a mineral oil in a ratio of between 1:5 and 1:30.

Preferably, tackiness of the gelatinous compound has been removed by the introduction of an antioxidant during the compounding process.

Further aspects of the invention will become apparent from the following description which is given by a way of example only to illustrate the invention.

BRIEF DESCRIPTION OF THE DRAWINGS

An example of the invention will be described with reference to the accompanying drawings in which.

DESCRIPTION OF THE PREFERRED EMBODIMENTS

Figure 1:
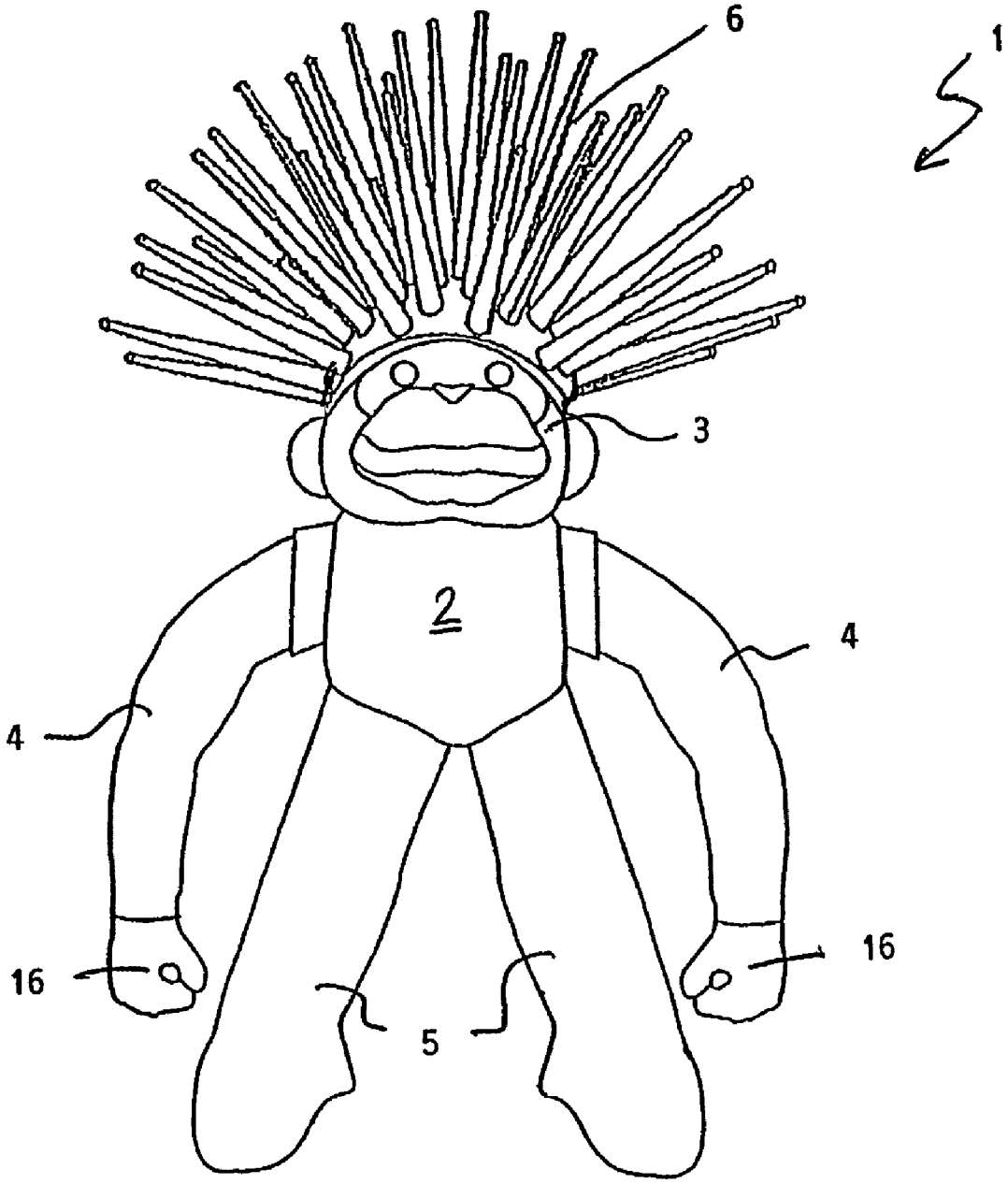
FIG. 1 illustrates a soft toy having deformable arms and hair according to the invention.
Figure 2:
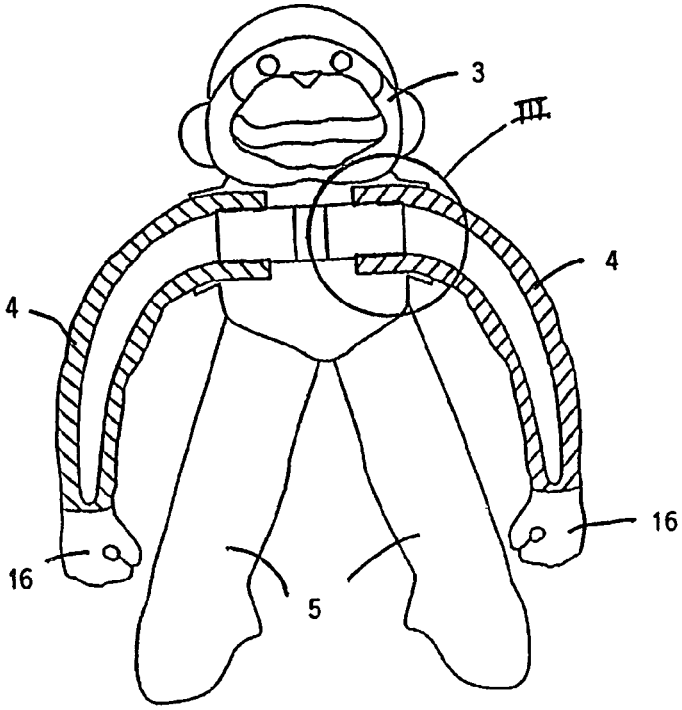
FIG. 2 is a sectional view of the toy showing attachment of the arms.
Figure 3:
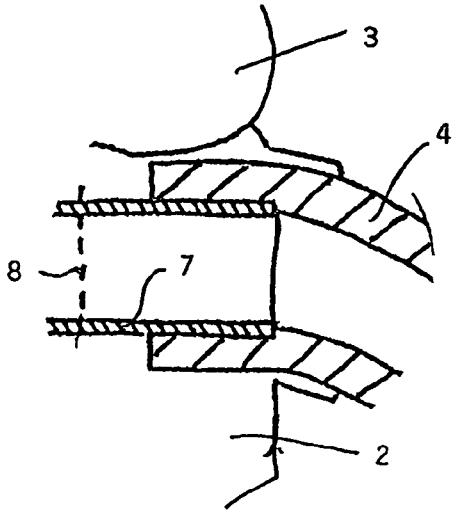
FIG. 3 is an enlarged view of the joint III in FIG. 2.
Figure 4:
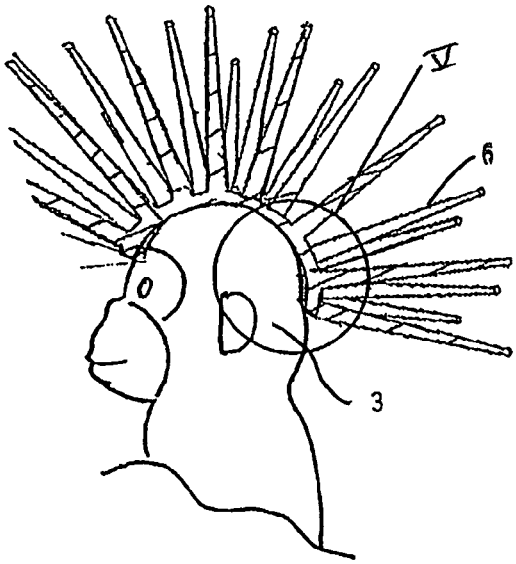
FIG. 4 is the head of the toy.
Figure 5:
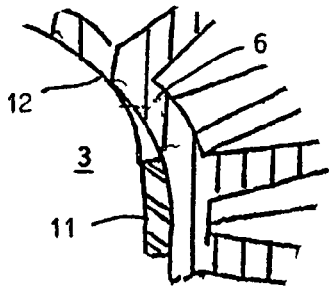
FIG. 5 illustrates attachment of the hair detail in V of FIG. 4.
Figure 6:
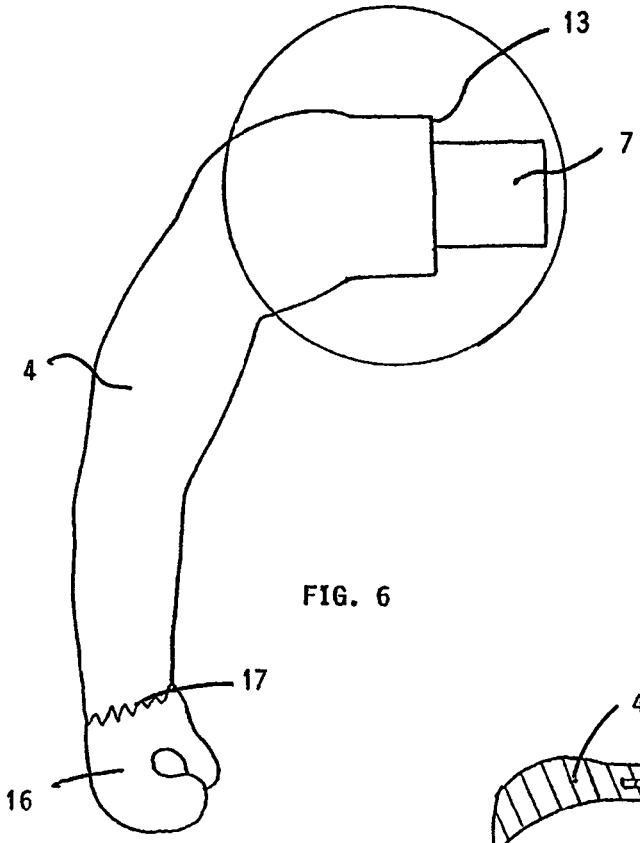
FIG. 6 illustrates the arm component of the toy.

FIGS. 1 through 10 depict a soft toy in a monkey shape. The monkey comprises a body 2 with head 3, disproportionately long arms 4 and legs 5. The head 3 has features such as eyes, nose, mouth and ears on its exterior and a crop of wildly sparkly hair 6. The body, legs and head of the monkey are constructed in known manner with a soft plush textile covering filled with soft resilient cotton fiber filler.

The arms 4 and hair 6 of the toy are made of a soft and highly flexible gelatinous compound. This gelatinous compound is described in applicant's UK patent 2391869, the contents of which are incorporated herein by reference. It consists of SEEPS or SEBS and a mineral oil in the ratio of between 1:5 and 1:30. The compound has its tackiness removed by the introduction of an antioxidant during the compounding process. Being made of this compound the arms 4 and hair 6 of the toy are resiliently stretchable and deformable by children in play.

The arms 4 and hair 6 are made by forming the gelatinous compound in a mold in the desired shape. During molding a fabric attachment sleeve 7 is bonded to the joint end of the gelatinous compound part. The parts, arms 4 and hair 6, are attached to the toy 1 by sewing the fabric attachment sleeve 7 to the toy at a seam 8.

A mold is produced in known-manner for forming the gelatinous material into the desired shape of the toy or doll part, in this case arms 4 and hair 6. The arms 4 are made hallow so as to be more flexible and stretchy. The fabric sleeve 8 is positioned with one of its ends in the mold and the mold closed. Molten gelatinous compound is injected into the mold, and as the gelatinous compound sets it is fused to the end of the textile sleeve 7. On ejection from the mold there is preformed a body part, such as arm 4 of FIG. 6, that has at one joint end 13 a portion of the textile sleeve 7 expose for sewing the part to the toy 1.

Figure 7:
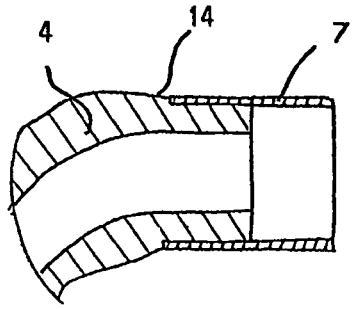
Figure 8:
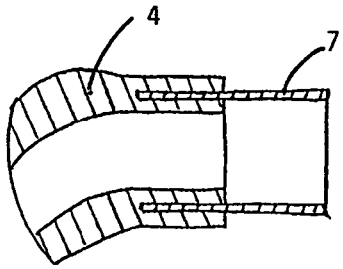
Figure 9:
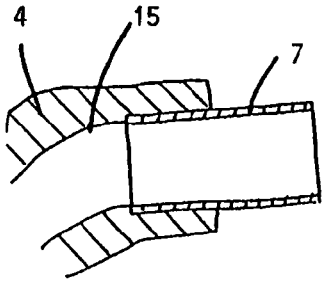
FIGS. 9 through 10 illustrate bonding of a joining sleeve to the arm.
Figure 10:
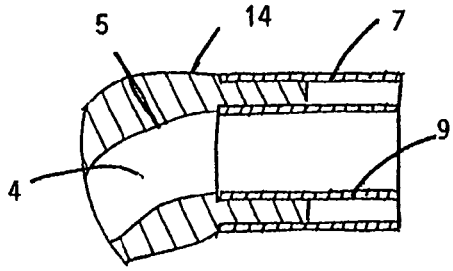

The sleeve 7 can be bonded to the arm in different ways as depicted in FIGS. 7 through 10. In FIG. 7 the sleeve 7 is bonded to the external surface 14 of the arm 4 wall. In FIG. 8 the sleeve is sandwiched within the wall of the hallow arm 4. In FIG. 9 the sleeve 7 is bonded on the internal surface 15 of the arm 4 wall. In FIG. 10 two sleeves 7 and 9 are bonded one each on the external surface 14 and the external surface 15 of the arm 4 wall for additional strength.

In attaching an item such as hair 6, which is molded in solid form, fabric tabs 11 are inserted in the mould to bond with the underside 12 of the hair 6. The tabs 11 are then sewn to the head 3 of the toy.

Hands 16 at the distal ends 17 of the arm 4 can be formed with gelatinous material such that they are entirely of the solid gelatinous material. Alternatively, hands 16 are made of plush fabric filled with cotton fiber and sewn to second sleeves bonded with the distal end 17 of the hallow arms 4 in the same manner as sleeves 7.

Figure 11:
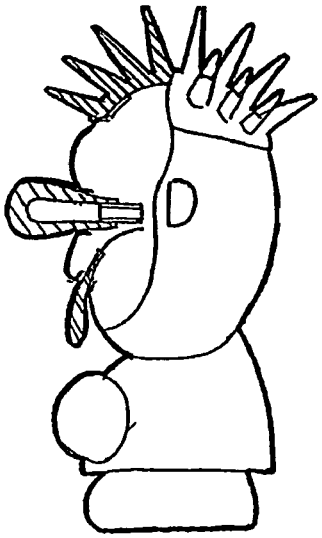
FIGS. 11 to 15 illustrate different toys having features of the invention.
Figure 12:
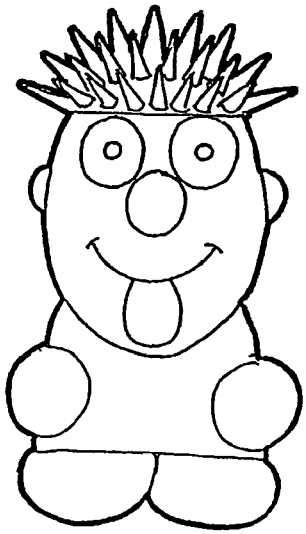
Figure 13:
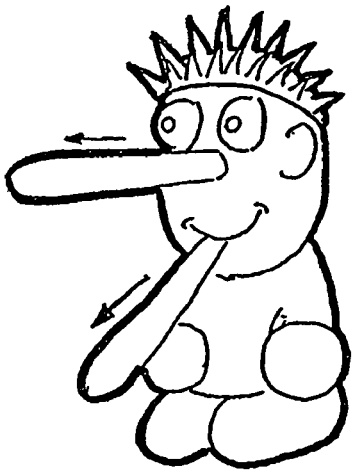
Figure 14:
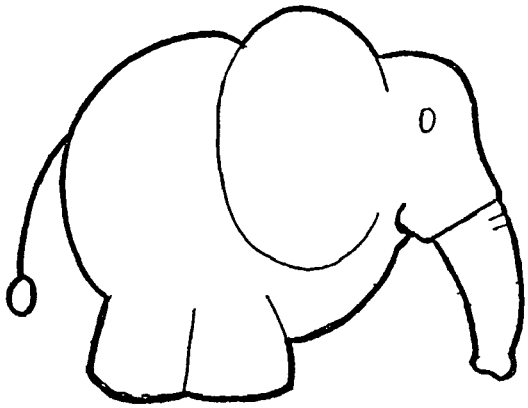
Figure 15:
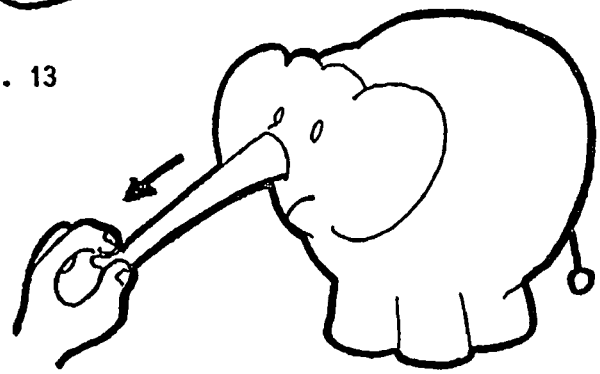

FIGS. 11 through 15 show how the invention can be used to produce other toys. In FIGS. 11 through 13 a humanoid doll has a nose, tongue and hair made of gelatinous material so as to produce stretchy deformable facial features of the doll. In FIGS. 14 and 15 a toy elephant is made with a gelatinous compound trunk that can be stretched and deformed.

It should be appreciate that modifications and alternations obvious to those skilled in the art are not to be considered as beyond the scope of the present invention. For example, the outer elastic compound may be of another type. Other suitable materials which are highly elastic and of comparable softness may be used which include:

Thermoplastic Rubber (TPR) compounds and alloy

Thermoplastic Polyurethane (TPU) compounds and alloys

Thermoplastic Vulcanizates (TPV) compounds and alloys

Thermoplastic Olefins (TPO) compounds and alloys

Poly Vinyl Chloride (PVC) compounds and alloys

Gelatinous compositions of Styrene Block Copolymers (SBC)

Natural Rubber.

What is claimed is:

1. A toy comprising a figure of a human or an animal having at least one appendage made of a resiliently stretchable material and a fabric piece, the fabric piece and the appendage being an integral pre-molded part wherein the fabric piece is fused directly to the appendage during molding of the appendage, and wherein the appendage is attached to the figure by stitching the fabric piece to the figure.

2. The toy of claim 1 wherein the appendage is formed in a mold with the fabric piece so that the fabric piece is fused directly to the appendage as the resiliently stretchable material sets.

3. The toy of claim 1 wherein the appendage is made of a gelatinous compound.

4. The toy of claim 1 wherein fabric piece is a fabric sleeve that is fused about an outer end of the appendage.

5. The toy of claim 1 wherein the appendage has a distal end having an indentation or hollowed end into which the fabric piece is fused.

6. The toy of claim 1 wherein the appendage has a wall and is hollow at its center and the fabric piece has an end that is fused within the wall.

7. The toy of claim 1 wherein the gelatinous compound is an elastomeric gel plastic.

8. The toy of claim 1 wherein the resiliently stretchable material is a gelatinous compound consisting of SEEPS or SEBS and a mineral oil in a ratio of between 1:5 and 1:30.

9. The toy of claim 1 wherein resiliently stretchable material is a gelatinous compound and surface tackiness of the gelatinous compound has been removed by the introduction of an antioxidant during the compounding process.

* * * * *